United States Patent [19]

Pluschkell et al.

[11] 4,015,475

[45] Apr. 5, 1977

[54] METHOD OF AND DEVICE FOR STRIPPING OFF A LOST MEASURING HEAD DETACHABLY PLACED UPON A MEASURING LANCE

[75] Inventors: Wolfgang Pluschkell, Dortmund-Wambel; Heinrich Wisnewski, Dortmund, both of Germany

[73] Assignee: Hoesch Werke Aktiengesellschaft, Dortmund, Germany

[22] Filed: Dec. 10, 1975

[21] Appl. No.: 639,224

[30] Foreign Application Priority Data

Dec. 10, 1974 Germany ..... 2458256

[52] U.S. Cl. ..... 73/343 R; 73/432 R

[51] Int. Cl.[2] ..... G01K 1/14

[58] Field of Search ..... 73/432 R, 359 R, 343 R, 73/343 B, 343 F, 354, DIG. 9; 136/234

[56] References Cited

UNITED STATES PATENTS

| | | | |
|---|---|---|---|
| 2,493,078 | 1/1950 | Mead | 136/234 |
| 3,672,222 | 6/1972 | Stelts et al. | 136/234 |
| 3,785,947 | 1/1974 | Baldwin et al. | 136/234 |

*Primary Examiner*—Donald O. Woodiel
*Attorney, Agent, or Firm*—Walter Becker

[57] ABSTRACT

A method of and device for stripping off a lost measuring head which is detachably placed on the immersible end of a measuring lance and is embedded in a protective tube extending above the measuring lance. According to the method of the invention, compressed air is introduced into the lance within the region of the sealed free end of the lance after pulling the lance for stripping off the lost measuring head.

8 Claims, 5 Drawing Figures

FIG. 1
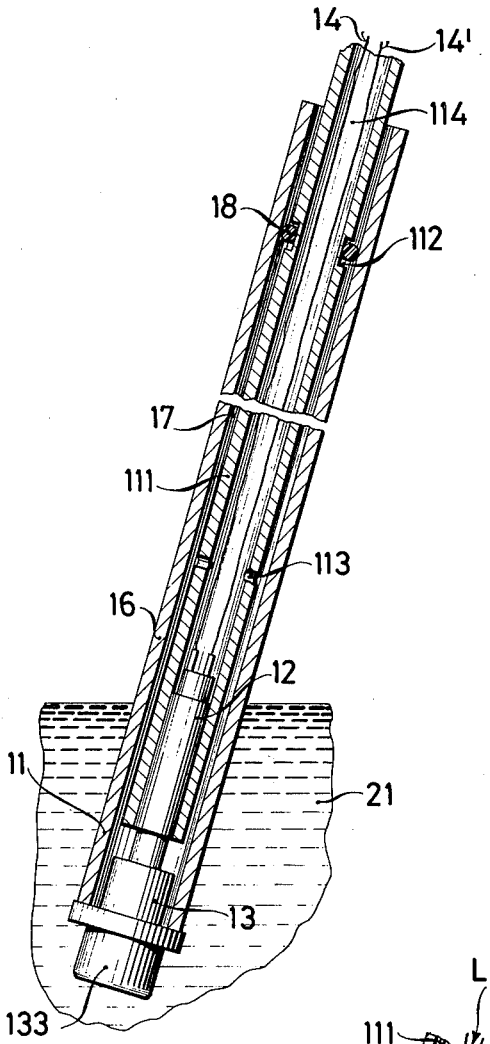
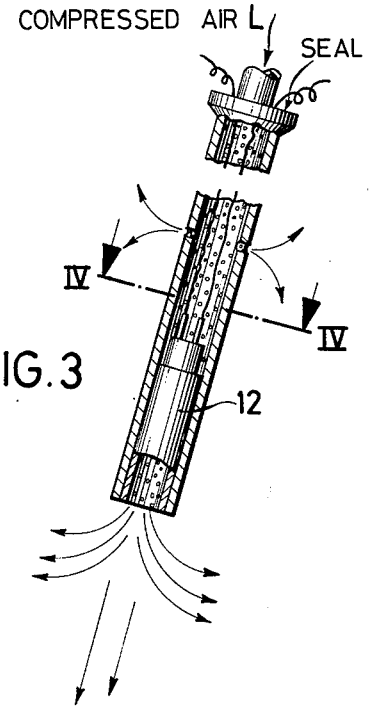
FIG. 3
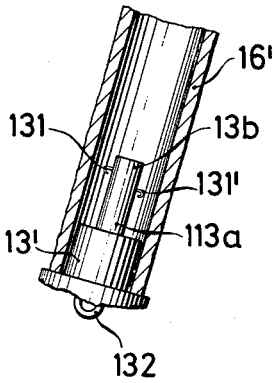
FIG. 3a
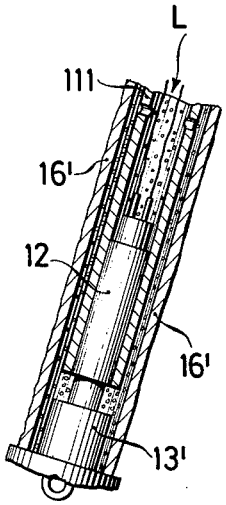
FIG. 2
FIG. 4
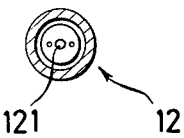

METHOD OF AND DEVICE FOR STRIPPING OFF A LOST MEASURING HEAD DETACHABLY PLACED UPON A MEASURING LANCE

The present invention relates to a method of stripping off a lost measuring head which is detachably placed on the immersible end of a measuring lance and is embedded in a protective tube extending above the measuring lance.

Measuring devices of this type serve for measuring the temperature and/or activities in melts, especially in metallic baths, by immersing the measuring head into the melt. The lost measuring head is after the effected measurement stripped off from the lance and is replaced by a new measuring head. The stripping-off of the used up measuring head has heretofore been effected mechanically and is particularly difficult when larger melting units or labels and accordingly long measuring lances are involved.

It is, therefore, an object of the present invention to provide a method and device which will greatly facilitate the stripping off of the used up measuring head from the lance.

This object and other objects and advantages of the invention will appear more clearly from the following specification in connection with the accompanying drawing, in which:

FIG. 1 shows the immersible end of a measuring lance according to the invention in its measuring position.

FIG. 2 shows the pulled measuring lance.

FIGS. 3 and 3*a* show the phase of separating the measuring head from the measuring lance.

FIG. 4 represents a section taken along the line IV—IV of FIG. 3.

The method according to the present invention is characterized primarily in that after pulling the lance, compressed air is introduced into the lance within the region of the sealed end of the lance.

This way of removing the lost measuring head from the measuring lance is extremely simple and does not require particular manipulation. The stripping operation furthermore is effected quickly and can be initiated early. As a result thereof, the further advantage is realized that the overheating danger of the immersible end of the measuring lance to be re-employed will be reduced.

Advantageously, the supply of compressed air is continued also after the stripping off of the measuring head in order to withdraw the accumulated heat from the measuring lance under which heat in particular the plug contacts located in the lance end and intended for the connection of the measuring head are exposed to the danger of oxidizing or freezing together.

For carrying out the method of the invention, there is provided a measuring lance which within the region of the free sealed end of the lance is provided with a connection for the supply of compressed air and in which the plug embedded in the immersible end of the lance for the connection of the measuring head to the measuring line is provided with a passage for compressed air, said measuring head being embedded in a protective pipe which extends over the measuring lance.

In order to assure the build-up of the pressure required for stripping the measuring head from the measuring lance, an annular seal, for instance an O-ring, may be provided between the protective pipe surrounding the measuring lance with play on one hand and the measuring lance on the other hand. Said annular seal may be arranged in spaced relationship from that end of the measuring lance which is intended to be immersed. Expediently, the said annular seal may be inserted in an annular groove provided in the measuring lance.

According to a further development of the invention, perforations for the lateral passage of compressed air may be provided in the wall of the measuring lance below said annular groove and in spaced relationship to that end of the lance which is intended to be immersed so that the build-up of the pressure in front of the measuring head to be stripped off will be accelerated.

Referring now to the drawing in detail, a socket 12 is embedded in that end 11 of the measuring lance which is intended to be immersed. From the socket 12 connecting wires 14, 14' lead to the free end of the measuring lance. The measuring head 13 is provided with a plug **13*a* equipped with terminals 131, 131' (FIG. 3) which are adapted to be introduced into the socket 12 forming a component of the lance 111 so that said terminals establish electric contact with said wires 14, 14'. The measuring head 13 is embedded in a protective pipe 16 which extends around the measuring head 13 and the adjacent portion 11 of the measuring lance in spaced relationship thereto so that an annular space 17** is provided.

A sealing ring 18 is inserted into an annular groove 112 of the measuring lance which groove is provided in longitudinally spaced relationship to said socket 12. The sealing ring 18 seals the annular chamber 17 between the measuring lance of the protective pipe 16 toward the outside. The socket 12 has a central longitudinal bore 121 (see FIG. 4) for conveying compressed air through said socket onto the free end face **13*b* of the plug 13*a* to thereby push said plug 13*a* out of the socket 12 for stripping the measuring head 13 from the lance 11, 111. In the wall of the measuring lance between the annular groove 112 and ring 18 therein on one hand and the socket 12 on the other hand in spaced relationship to the latter, there are provided perforations 113 leading from the interior of the lance to the annular space 17.**

The measuring lance ready for measuring and equipped with a not yet used measuring head 13 is for purposes of carrying out a measuring operation immersed into the metallic bath 21 (FIG. 1). When this occurs, the protective cap 133 of the measuring head 13 melts off, and the measuring contact 132 and the melt 21 begin to act upon each other. After the measuring operation has been completed during which also the surface of the protective pipe 16 will be somewhat attacked (FIG. 2), the measuring lance is pulled out of the melt 21. After the pulling of the lance, the interior 114 of the lance will from the free end thereof be acted upon by compressed air (arrow L) which brings about a pressure build-up in front of the used measuring head 13' i.e., in the annular chamber 17 between the protective pipe 16 and the measuring lance whereby the measuring head 13' aided by the pressure acting through bore 121 upon the plug surface **13*b* will together with the protective tube 13' be stripped off from the measuring lance which can again be used. Also after removal of the measuring head 13', the compressed air conveyed to the measuring lance brings about a cooling of the lance end 11, and in particular also of the socket 12.**

It is, of course, to be understood that the present invention is, by no means, limited to the specific showing in the drawing, but also comprises any modifications within the scope of the appended claims.

What we claim is:

1. A method of stripping off a lost measuring head which is detachably mounted on a measuring lance having its free end sealed and which head is embedded in a protective tube extending over the measuring lance, which includes the steps of withdrawing the lance out of the measuring medium subsequent to the measurement, introducing compressed air into the lance to build up pressure in the region of the free end, and conveying the pressure in the direction from the free end of the lance toward and onto said measuring head to thereby strip the measuring head off said lance.

2. A method according to claim 1, which includes the step of introducing the compressed air into the lance within the region of the sealed free end of said lance.

3. A method according to claim 1, which includes continuing feeding compressed air into said lance for a desired time to conduct away heat accumulated in said lance.

4. In combination, a measuring lance having a longitudinal bore and also having a first end section to be immersed into a melt and also a second end section forming a free sealed end section, connecting means provided at said second end section for connection with a source of compressed air, a socket fixedly mounted in said first section, a protective tubular cover surrounding said lance and said socket and protruding beyond said socket in the direction away from said second end section of said lance, a measuring head arranged within and surrounded by that portion of said tubular cover which protrudes beyond said socket in the direction away from said second lance section, said measuring head being provided with a plug member normally engaging said socket, measuring conductor lines respectively normally electrically connected to said plug member and extending through said lance for connection with a measuring device, and fluid pressure conveying means for conveying fluid pressure through said second section to said measuring head to strip the latter from said lance.

5. An arrangement according to claim 4, in which said fluid pressure conveying means includes passage means provided in said socket for conveying therethrough compressed air from said connection to said measuring head to strip the latter from said lance in response to the admission of compressed air into said lance and through said longitudinal bore.

6. An arrangement according to claim 4, which includes an annular seal provided between an outer peripheral portion of said measuring lance which is axially spaced from said plug and the inner peripheral portion adjacent to said outer peripheral portion of said lance.

7. An arrangement according to claim 6, in which said annular seal is located in a peripheral groove of said lance.

8. An arrangement according to claim 6, in which said fluid pressure conveying means includes passage means provided in the wall of said measuring lance and arranged between said annular seal and said socket.

* * * * *